United States Patent [19]

Akisue et al.

[11] Patent Number: 4,478,649

[45] Date of Patent: Oct. 23, 1984

[54] METHOD FOR PRODUCING A COLD-ROLLED STEEL SHEET HAVING EXCELLENT FORMABILITY

[75] Inventors: Osamu Akisue; Seiryo Hatae; Hiroaki Toki, all of Himeji; Kichi Nakazawa, Tokai; Atsuhiro Wakako, Tokyo, all of Japan

[73] Assignee: Nippon Steel Corporation, Tokyo, Japan

[21] Appl. No.: 464,067

[22] Filed: Feb. 4, 1983

[30] Foreign Application Priority Data

Feb. 9, 1982 [JP] Japan ..... 57-18188

[51] Int. Cl.[3] ..... C21D 8/04

[52] U.S. Cl. ..... 148/12 C; 148/12.3

[58] Field of Search ..... 148/12 R, 12 C, 12 D, 148/12.1, 12.3, 12.4

[56] References Cited

U.S. PATENT DOCUMENTS

| | | | |
|---|---|---|---|
| 3,821,031 | 6/1974 | Kubotera et al. | 148/2 |
| 3,879,232 | 4/1975 | Gondo et al. | 148/12 C |
| 4,315,783 | 2/1982 | Akisue et al. | 148/12 C |

FOREIGN PATENT DOCUMENTS

| | | | |
|---|---|---|---|
| 41354 | 12/1981 | European Pat. Off. | 148/12 C |
| 115948 | 9/1980 | Japan | 148/12 C |

*Primary Examiner*—Peter K. Skiff

*Attorney, Agent, or Firm*—Wenderoth, Lind & Ponack

[57] ABSTRACT

In a method for producing a cold-rolled steel sheet by continuously casting, hot-rolling, cold-rolling, and continuously annealing Al-killed steel, it is known to coil a hot-rolled strip at a coiling temperature of 630° C. to 710° C. so as to attain satisfactory precipitation of AlN in the hot-rolling step. When the direct-rolling of a continuously cast strand (DR method) is employed to produce a cold-rolled strip, it is impossible to attain satisfactory precipitation of AlN even by carrying out the known coiling method. The present invention is characterized in that an extremely high coiling temperature of at least 780° C. is used to essentially prevent aging due to the precipitation of AlN, and, further, the carbon content of a continuously cast slab is 0.005% at the highest so as to essentially prevent the occurrence of orange peel. Heat conservation due to use of the DR method and excellent properties of the cold-rolled steel strip are simultaneously attained.

7 Claims, 2 Drawing Figures

METHOD FOR PRODUCING A COLD-ROLLED STEEL SHEET HAVING EXCELLENT FORMABILITY

The present invention relates to a method for producing a cold-rolled steel sheet having excellent formability. More particularly, the present invention relates to a method for producing a cold-rolled steel sheet having excellent formability by continuously casting, hot-rolling, cold-rolling, and continuously annealing Al-killed steel.

Since it is difficult to reduce the amount of solute atoms during continuous annealing, it is necessary to reduce the amount of soluble atoms as much as possible before the continuous annealing is carried out. Therefore, molten steel is subjected to vacuum degassing so as to decrease the impurities as much as possible and thus decrease the amount of solute atoms contained in a hot-rolled steel strip.

Since the precipitation of AlN during the cooling process in continuous annealing is liable to be unsatisfactory, U.S. Pat. No. 3,821,031 proposes to coil a hot-rolled strip at a high coiling temperature of 630° C. or more so as to attain satisfactory precipitation of AlN in the hot-rolling step. More specifically, U.S. Pat. No. 3,821,031 discloses a method for producing a cold-rolled steel sheet, which comprises the following steps: melting an Al-killed steel containing 0.010% or less of carbon, 0.40% or less of manganese, and 0.020% of soluble aluminum—(hereinafter referred to as sol.Al), the carbon content being decreased by vacuum degassing; forming a slab by ingot making or continuous casting; hot-rolling, in which a hot-rolled strip is coiled at 630° C. or more; cold-rolling; and annealing, in which the steel strip is rapidly heated to and held at an annealing temperature. The maximum coiling temperature specifically recited in the U.S. Pat. No. 3,821,031 is 710° C.

Recently, conventional ingot making methods have mainly been replaced by continuous casting since continuous casting has advantages which are very evident to persons skilled in the art.

Because of the need to conserve thermal energy in the production of steels, there have recently been employed a method (hereinafter referred to as DR) in which a continuously cast strand is not cooled to room temperature but instead is directly rolled at a retained high temperature, and a method (hereinafter referred to as HCR) in which a continuously cast slab is loaded into a slab-heating furnace at a retained high temperature. The higher the retained temperature in a continuously cast slab, the greater the amount of thermal energy which can be conserved. However, in Al-killed steels, if the temperature of a continuously cast slab is maintained above the $Ar_3$ point, until hot-rolling is carried out, it is impossible to attain satisfactory precipitation of AlN even if the known coiling method proposed in U.S. Pat. No. 3,821,031 is employed at a high temperature of from 630° C. to 710° C. in hot-rolling.

It is an object of the present invention to achieve satisfactory precipitation of AlN by means of a method for producing a cold-rolled steel sheet, in which method continuous annealing is carried out and the temperature of a continuously cast slab is not lowered to below the $Ar_3$ point, i.e., the temperature of the steel is maintained above the $Ar_3$ point between the continuous casting step and the hot-rolling step, thereby enabling the production of a cold-rolled steel sheet having excellent formability.

The present invention is characterized in that an extremely high coiling temperature of at least 780° C. is used in the hot-rolling step so as to essentially prevent aging due to the precipitation of AlN, and, further, the carbon content of the continuously cast slab is made very low, i.e., 0.005% at the highest, so as to essentially prevent the occurrence of orange peel on the cold-rolled steel strip.

In accordance with the objects of the present invention, there is provided a method for producing a cold-rolled steel sheet having excellent formability, comprising the steps of:

continuously casting steel containing 0.005% of carbon at the highest, from 0.01% to 0.10% of acid-soluble aluminum, and 0.006% of nitrogen at the highest, the balance being iron and unavoidable impurities;

hot-rolling continuously cast slab;

maintaining the continuously cast slab at a temperature above the $Ar_3$ point until it is hot-rolled;

coiling the hot-rolled steel strip at a temperature of at least 780° C.;

cold-rolling the hot-rolled steel strip; and continuously annealing the cold-rolled steel strip for a short period of time.

The present invention is explained with reference to the drawings.

Figure 1:
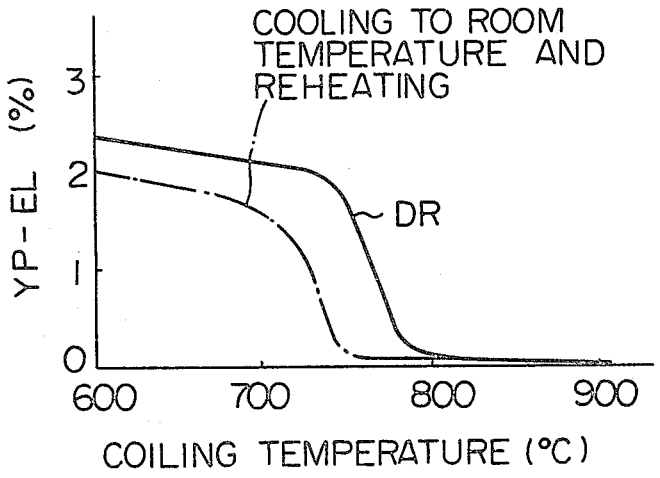
FIG. 1 is a graph illustrating the relationship between the coiling temperature and the yield point elongation due to aging.

In FIG. 1, the solid curve indicates the relationship between the yield point elongation and the coiling temperature regarding cold-rolled steels produced by successively: continuously casting an Al-killed steel containing 0.002% of carbon, 0.15% of manganese, 0.020% of phosphorus, 0.015% of sulfur, 0.040% of sol.Al, and 0.0032% of nitrogen; maintaining the temperature of the continuously cast slabs at 1000° C. or higher; hot-rolling the continuously cast slabs without heating them (the DR method), at a finishing-rolling temperature of 900° C.; coiling the resultant hot-rolled strips; cold-rolling the hot-rolled strips; continuously annealing the cold-rolled strips at 800° C. for 60 seconds; and, finally, skin pass-rolling the continuously annealed strips by 0.8%. A coiling temperature of at least 780° C. is necessary, as is clear from FIG. 1, in order to keep the yield-point elongation very low, i.e., 1% or less, and thus prevent aging due to the precipitation of AlN.

The broken curve in FIG. 1 indicates cold-rolled steel sheets produced by the same process as that used to produce the above-described cold-rolled steels except that continuously cast slabs were cooled to room temperature and then were reheated to a rolling temperature.

Al-killed steels containing up to 0.02% of carbon were continuously cast, were maintained at a temperature of at least 1000° C. until hot-rolling, and were hot-rolled, followed by coiling, at a temperature of 700° C., 750° C., and 800° C., respectively. The relationship between the occurrence of orange peel in the final product and the coiling temperature was investigated with respect to these three different coiling temperatures. The results are illustrated in FIG. 2.

Figure 2:
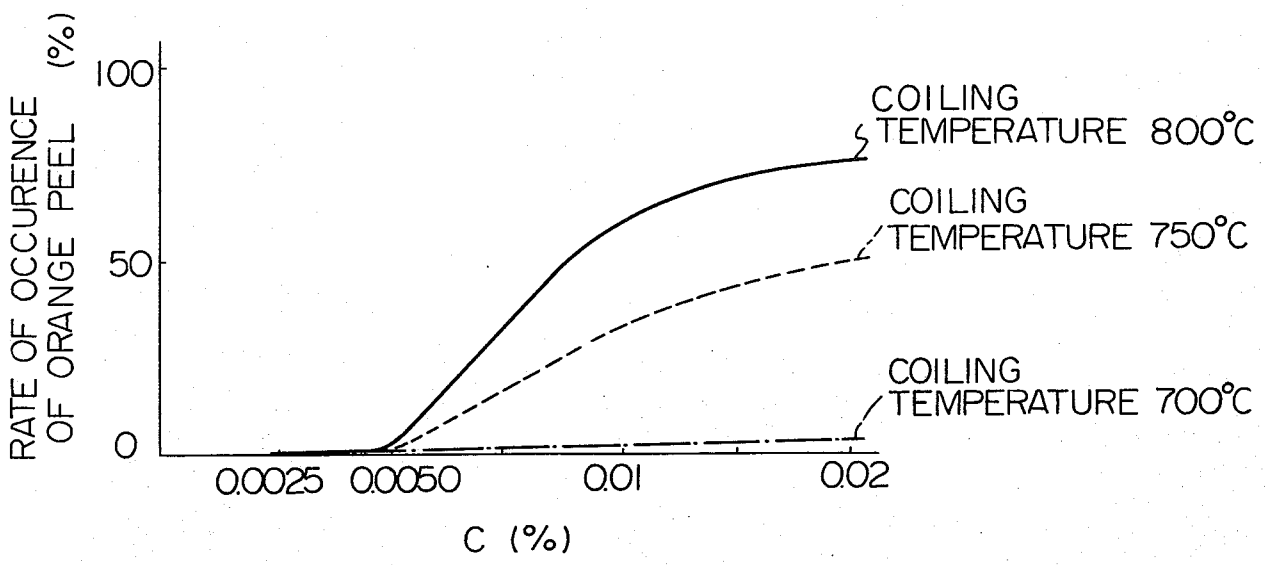
FIG. 2 is a graph illustrating the relationship between the carbon content of a continuously cast slab and the rate of occurrence of orange peel.

As is clear from FIG. 2, when the coiling temperature was 700° C., the carbon content exerted almost no influence on the occurrence of orange peel. However, when the coiling temperature was 750° C., or 800° C., an increase in the carbon content resulted in an abrupt increase in the rate of occurrence of orange peel.

Incidentally, U.S. Pat. No. 3,821,031 claims a carbon content of 0.010% or less and discloses Al-killed steel having a carbon content of 0.004% at the lowest. In addition, U.S. Pat. No. 3,821,031 claims a coiling temperature of 630° C. at the lowest, and discloses a coiling temperature of 700° C. for the above-mentioned Al-killed steel. Thus, the prior art, including U.S. Pat. No. 3,821,031 seems to indicate that good surface properties can be maintained by keeping the maximum coiling temperature at approximately 700° C. at the highest, thus suppressing grain growth.

According to a discovery made by the present inventors, the aluminum nitride is precipitated by a coiling temperature of at least 780° C., and good surface properties and thus prevention of the occurrence of orange peel, can be attained by controlling the carbon content to a maximum of 0.005%, preferably 0.003%.

The method according to the present invention is explained hereinafter in detail.

The starting material of the method according to the present invention is produced in a conventional manner in a converter, and a vacuum-degassing installation or any other known steel making installation. The obtained molten steel is then continuously cast by using a well-known continuous casting installation so as to obtain a slab. Desirably, the temperature of a slab is the high as possible so as to effectively carry out the DR and HCR methods. Therefore, extremely intense cooling of a strand should be avoided during continuous casting.

It is significant in the present invention that a continuously cast slab has the following chemical composition: a carbon content of 0.005% or less, preferably 0.003% or less; an acid-soluble aluminum content of from 0.01% to 0.10%; and a nitrogen content of 0.006% at the highest. Aluminum is a deoxidizing element, forms a compound with nitrogen and prevents the precipitation of nitrogen.

An acid-soluble aluminum content of less than 0.010% is too low to attain satisfactory deoxidation and to prevent aging when the nitrogen content of a strand is the usual content, i.e., 0.006% at the highest. In other words, a slab may contain 0.006% of nitrogen at the highest because the acid-soluble aluminum content is as specified above. However, in order to suppress aging due to nitrogen, the nitrogen content is desirably as low as possible, and, therefore, vacuum-degassing or combined blowing is carried out to remove the nitrogen from the molten steel. When the nitrogen content exceeds 0.006%, the amount of aluminum which is added to the molten steel to prevent aging is disadvantageously great.

The content of silicon, phosphorus, sulfur, and the like is not specified. However, when the content of silicon, phosphorus, sulfur, and the like is low, the properties of the cold-rolled steel sheet are better, as is evident to a person skilled in the art. Desirably, the silicon content is 0.02% at the highest, the phosphorus content is 0.03% at the highest, and the sulfur content is 0.03% at the highest.

The manganese content is also not specified. Usually, in a continuously cast slab the manganese content is not high enough to deteriorate the hot workability thereof; e.g., the manganese content is approximately 0.5% at the highest. However, a manganese content of 0.30% at the highest is, desirable from the point of view of the formability of the final product.

A continuously cast slab having the chemical composition described above is held above the $Ar_3$ point until the hot-rolling step. That is, the temperature of the continuously cast slab is gradually lowered but is not lowered even once to less than the $Ar_3$ point. When the temperature of the continuously cast slab is such that hot-rolling is feasible, the DR method is carried out. On the other hand, when this temperature is too low for hot-rolling to be feasible, the HCR method is carried out and the continuously cast slab is heated in a heating furnace to a temperature at which hot-rolling is feasible.

A continuously cast slab is hot-rolled in a conventional manner, i.e., it is rough-rolled and then finish-rolled. The hot-rolled strip is coiled at a temperature of 780° C. or more, according to a feature of the present invention, with the result that the material properties, i.e., the anti-aging property and the elongation, of the cold-rolled sheet are improved. A coiling temperature of 780° C. or more can be realized by various means. The most advantageous means is to locate a coiler adjacent to the hot-rolling mill. The distance between the coiler and the final finishing stand of the hot-rolling mill may be 45 m or less. Aluminum nitride (AlN) is precipitated in the coiled hot-rolled steel strip when the temperature is slowly lowered from a high coiling temperature to room temperature, and aluminum nitride (AlN) precipitation is promoted when the coiled hot-rolled steel strip is cooled in a heat-insulating means. For example, the coiled hot-rolled steel strip is covered with a heat-insulating cover.

In order to enhance the pickling property of the hot-rolled steel strip, the coiled hot-rolled steel strip may be immersed in water and rapidly cooled. The scale on the rapidly cooled strip can be easily removed.

A hot-rolled steel strip which has the thickness of from 2.0 to 5.0 mm is successively subjected to conventional pickling, cold rolling, continuous annealing, and skin pass rolling. In the continuous annealing the heat cycle is such that rapid heating, holding at 680° to 900° C., and then cooling are successively carried out.

The present invention is hereinafter explained by way of an example.

Continuously cast slabs were successively subjected to the following steps: the formation of 3.5 mm-thick hot-rolled steel strips; pickling; the formation of 0.8 mm-thick cold-rolled steel strips; continuous-annealing, including holding at 800° C. for 60 seconds; and skin pass-rolling by 0.8%.

In the Table below, Steel Nos. 1, 2, and 5 were subjected to the DR method, and Steel Nos. 3, 4, and 6 were subjected to the HCR method. In Steel Nos. 1 and 3, the cold-rolled strips exhibited no orange peel, although the hot-rolled steel strips were coiled at a very high temperature. When the carbon content was high and the coiling temperature was very high, as in Steel No. 2, orange peel occurred on the cold-rolled steel strips. The yield-point elongation (YP-El) of Steel Nos. 1 and 3 was less than 1%, indicating that an anti-aging property was obtained due to a high coiling temperature and a low carbon content. On the other hand, when the coiling temperature was low, as in Steel Nos. 5 and 6, appreciable aging occurred.

Steel No. 7 was subjected to cooling to room temperature after continuous casting and reheating and exhibited an anti-aging property and a good surface. However, since the method used involved cooling the continuously cast slab to room temperature, it was very disadvantageous from the standpoint of energy conservation.

| No. | Chemical Composition (%) C | Si | Mn | P | S | solAl | N | Lowest Temperature of Slab Until Hot-Rolling (°C.) | Heating Temperature of Slab (°C.) | Finishing Temperature of Hot-Rolling (°C.) |
|---|---|---|---|---|---|---|---|---|---|---|
| ① | 0.002 | 0.01 | 0.22 | 0.01 | 0.01 | 0.025 | 0.0031 | 1000 | — | 900 |
| 2 | 0.007 | 0.01 | 0.15 | 0.01 | 0.01 | 0.040 | 0.0025 | 1000 | — | 900 |
| ③ | 0.004 | 0.01 | 0.20 | 0.02 | 0.01 | 0.030 | 0.0018 | 950 | 1100 | 900 |
| 4 | 0.010 | 0.01 | 0.12 | 0.01 | 0.01 | 0.050 | 0.0035 | 950 | 1100 | 900 |
| 5 | 0.003 | 0.01 | 0.15 | 0.01 | 0.02 | 0.045 | 0.0040 | 1000 | — | 900 |
| 6 | 0.010 | 0.01 | 0.10 | 0.01 | 0.01 | 0.037 | 0.0028 | 950 | 1100 | 900 |
| 7 | 0.005 | 0.01 | 0.25 | 0.02 | 0.01 | 0.055 | 0.0025 | Room Temperature | 1100 | 900 |

| No. | Coiling Temperature (°C.) | Mechanical Properties Y.P (kg/mm²) | T.S (kg/mm²) | El (%) | Surface Condition (X-Orange Peel) | Aging (100° C. × 1 hr) YP-El (%) | A-I (kg/mm²) |
|---|---|---|---|---|---|---|---|
| 1 | 820 | 17.5 | 31.2 | 49.0 | o | 0 | 2.1 |
| 2 | 820 | 20.5 | 31.5 | 45.0 | x | 1.8 | 5.1 |
| 3 | 790 | 18.2 | 31.5 | 47.8 | o | 0.9 | 4.2 |
| 4 | 790 | 22.0 | 33.0 | 44.3 | x | 1. | 4.7 |
| 5 | 750 | 21.0 | 33.1 | 43.8 | o | 2.8 | 6.0 |
| 6 | 700 | 23.5 | 34.2 | 42.8 | o | 3.3 | 6.8 |
| 7 | 750 | 20.1 | 31.7 | 45.5 | o | 1.0 | 4.4 |

Remarks: No.①; ③ - Present Invention; A-I is aging index numbers in kg/mm².

We claim:

1. A method for producing a cold-rolled steel sheet having excellent formability, comprising the steps of:

continuously casting a steel containing 0.005% or less of carbon, from 0.01 to 0.10% of acid-soluble aluminum, and 0.006% or less of nitrogen, the amount of said aluminum being sufficient to suppress aging due to nitrogen at the coiling temperature defined below, the balance of the steel consisting essentially of iron and unavoidable impurities;

hot-rolling the resultant continuously cast slab, with the proviso that the temperature of the continuously cast slab is maintained above the $Ar_3$ point until the slab is hot-rolled;

coiling the resultant hot-rolled steel strip at a temperature of at least 780° C.;

cold-rolling the hot-rolled steel strip; and continuously annealing the cold-rolled steel strip.

2. A method according to claim 1, wherein said hot rolled steel strip is coiled by a coiler located adjacent to a hot-rolling mill.

3. A method according to claim 2, wherein the distance between the coiler and a final-finishing stand of the hot-rolling mill is 45 m or less.

4. A method according to claim 1, wherein the coiled hot-rolled steel strip is cooled in a heat-insulating means.

5. A method according to claim 1, wherein the carbon content of said continuously cast slab is 0.003% or less.

6. A method according to claim 1, wherein the continuously cast steel slab further contains 0.5% or less of manganese.

7. A method according to claim 1, wherein the continuously cast steel slab further contains 0.30% or less of manganese.

* * * * *